US010064454B2

(12) United States Patent
Mizumoto et al.

(10) Patent No.: US 10,064,454 B2
(45) Date of Patent: Sep. 4, 2018

(54) POLYAMIDE RESIN COMPOSITION FOR SLIDE FASTENERS, SLIDE FASTENER COMPONENT, AND SLIDE FASTENER PROVIDED WITH SAME

(71) Applicant: YKK Corporation, Tokyo (JP)

(72) Inventors: Kazuya Mizumoto, Toyama (JP); Masayoshi Kojima, Toyama (JP); Takanori Ozawa, Toyama (JP); Masahiro Hanyu, Toyama (JP); Hideki Sato, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 15/123,521

(22) PCT Filed: Apr. 9, 2014

(86) PCT No.: PCT/JP2014/060348
§ 371 (c)(1),
(2) Date: Sep. 2, 2016

(87) PCT Pub. No.: WO2015/155861
PCT Pub. Date: Oct. 15, 2015

(65) Prior Publication Data

US 2017/0079385 A1 Mar. 23, 2017

(51) Int. Cl.
*A44B 19/24* (2006.01)
*A44B 19/26* (2006.01)
*A44B 19/36* (2006.01)

(52) U.S. Cl.
CPC ..... *A44B 19/24* (2013.01); *A44B 19/26* (2013.01); *A44B 19/262* (2013.01); *A44B 19/36* (2013.01); *A41D 2500/50* (2013.01)

(58) Field of Classification Search
CPC ..... A44B 19/24; A44B 19/26; A44B 19/262; A44B 19/36
See application file for complete search history.

(56) References Cited

U.S. PATENT DOCUMENTS

2004/0231115 A1 11/2004 Keyaki et al.
2015/0017458 A1 1/2015 Mizumoto et al.
2015/0210834 A1 7/2015 Mizumoto et al.

FOREIGN PATENT DOCUMENTS

DE 3444813 A1 6/1986
JP 2004-344310 A 12/2004
(Continued)

OTHER PUBLICATIONS

International Search Report, PCT International Application No. PCT/JP2014/060348, dated Jul. 8, 2014.
(Continued)

*Primary Examiner* — Robert Sandy
*Assistant Examiner* — Michael S Lee
(74) *Attorney, Agent, or Firm* — Kilpatrick Townsend & Stockton LLP

(57) ABSTRACT

Provided is a polyamide resin composition that is suitable as a material for slide fastener parts having good strength after being dyed. A polyamide resin composition for a slide fastener, comprising a polyamide resin and reinforcing fibers, wherein a total mass of the polyamide resin and the reinforcing fibers is 90% by mass or more of the composition; wherein a proportion of an aromatic polyamide having a melting point of from 200 to 250° C. in the polyamide resin is more than 70% by mass; and wherein a content of the reinforcing fibers in the total mass of the polyamide resin and the reinforcing fibers is from 45 to 70% by mass.

15 Claims, 3 Drawing Sheets

(56) References Cited

FOREIGN PATENT DOCUMENTS

| | | | |
|---|---|---|---|
| JP | 4517277 | B2 | 8/2010 |
| JP | 2011-088944 | A | 5/2011 |
| WO | 2013/098978 | A1 | 7/2013 |
| WO | 2014/038045 | A1 | 3/2014 |

OTHER PUBLICATIONS

International Preliminary Report on Patentability, PCT International Application No. PCT/JP2014/060348, dated Oct. 20, 2016.

POLYAMIDE RESIN COMPOSITION FOR SLIDE FASTENERS, SLIDE FASTENER COMPONENT, AND SLIDE FASTENER PROVIDED WITH SAME

This application is a national stage application of PCT/JP2014/060348, which is incorporated herein by reference.

TECHNICAL FIELD

The present invention relates to a polyamide resin composition for a slide fastener. Moreover, the present invention relates to parts for a slide fastener, made of such a resin composition. Further, the present invention relates to a slide fastener comprising such parts.

BACKGROUND ART

Slide fasteners are opening and closing tools of articles which are used in daily necessities such as clothing, bags, footwear and household goods, as well as articles which are also used in industrial goods such as water storage tank, fishing nets and spacesuits.

FIG. 1 shows a structural example of a slide fastener. The slide fastener 10 is mainly composed of three parts which are a pair of elongated tapes 11, a number of elements 12 that are engaging parts of the fastener attached along one side edge of each tape, and a slider 13 for controlling the opening and closing of the fastener by engaging and separating the elements 12. Furthermore, a top stop 14 and an opener 15 can be provided in order to prevent the slider 13 from falling off, and on the surface of the slider 13, a pull tab 16 can be attached together with a pull tab cover 17 for fixing the pull tab 16 to the slider.

The components of the slide fastener are molded parts which can be produced by injection molding, and are known to be manufacturable from polyamides.

For example, DE 3 444 813 (Patent Document 1) discloses a method of injection molding a slider from a polyamide which has been reinforced with glass fibers for the purpose of improving durability of the slider used for a slide fastener for bedclothes against the washing and ironing, as well as a wear resistance of the slider to the sliding (claim 1). It discloses that a length of the glass fiber is 4 to 8 mm and its content is at least 25% by weight (claim 1). It discloses that the slider is subjected to a recrystallization treatment after being molded (claim 1). It also discloses that polyamide 6,6 is used as the polyamide (claim 6). Further, it also discloses that a slip additive- or gliding agent-free polyamide is used, and that the glass fiber content makes up about 40% by weight (claim 5).

Japanese Patent No. 4517277 (Patent Document 2) also discloses that polyamide resins can be used as parts for a slide fastener. This document mentions polyamide 6, polyamide 66, polyamide MXD6, polyamide 6T, polyamide 11, polyamide 12 and the like as the polyamide resins. It discloses that polyamide resins having 80 mol % or more of capramide repeating units and/or polyamide resins having 80 mol % or more of hexamethylene adipamide repeating units are particularly preferred.

WO 2013/098978 (Patent Document 3) discloses a polyamide resin composition containing 30 to 50% by mass of a polyamide and 50 to 70% by mass of reinforcing fibers, wherein 50% by mass or more in the polyamide is an aliphatic polyamide. Further, it discloses that in terms of improvement of a plating property, the aliphatic polyamide in the polyamide is preferably at least 80% by mass.

PRIOR ART DOCUMENT

Patent Document 1: DE 3 444 813
Patent Document 2: Japanese Patent No. 4517277
Patent Document 3: WO 2013/098978

SUMMARY OF INVENTION

Problem to be Solved by the Invention

Among the components of the slide fastener, the pull tab cover, the pull tab, the top stop, the bottom stop and the elements are particularly small, and are parts directly related to slider overall strength and chain crosswise strength, which are important mechanical properties of the slide fastener. When providing these parts as injection molded articles of polyamide resins, they are generally dyed in terms of aesthetics.

The prior arts as described above have proposed that an aliphatic polyamide such as polyamide 6, 6 should be a main ingredient and reinforcing fibers should be mixed in order to develop strength when producing parts for a slide fastener using a polyamide resin as a material. In fact, when producing a slider body by combining the aliphatic polyamide with the reinforcing fibers, the slider body can exhibit good strength after being dyed. However, according to research by the present inventors, it has been found that when small parts such as the pull tab cover, the pull tab, the top stop, the bottom stop and the elements as described above were produced from the material that had combined the aliphatic polyamide and the reinforcing fibers, the strength after being dyed was significantly reduced.

In view of the above circumstances, one object of the present invention is to provide a polyamide resin composition suitable as a material of slide fastener parts having good strength after being dyed. Further, another object of the present invention is to maintain the strength of small slide fastener parts after being dyed, which are made of a polyamide resin material. Furthermore, another object of the present invention is to provide a slide fastener comprising such parts for a slide fastener.

Means for Solving the Problem

The present inventors have studied the cause of the above-mentioned problems, and performed the following inference. The small parts such as the pull tab cover, the pull tab, the top stop, the bottom stop and the elements are smaller as compared with the slider body. Thus, since the orientations of the reinforcing fibers dispersed in the polyamide resin matrix are not aligned, effects of improving the strength by the reinforcing fibers cannot be sufficiently acquired. Further, the aliphatic polyamide significantly decreases in strength after water absorption. In view of these, when dyeing small parts made of a material which is a combination of the aliphatic polyamide with the reinforcing fibers, the strength of the aliphatic polyamide itself, which was decreased by water absorption, was reflected in the fastener parts.

The present inventors have searched polyamide resin materials which are less likely to decrease the strength after water absorption, and which are easily injection-molded into small parts, and have found that aromatic polyamides having a lower melting point are advantageous. The present invention has been completed on the basis of such findings.

In one aspect, the present invention is a polyamide resin composition for a slide fastener, comprising a polyamide resin and reinforcing fibers, wherein a total mass of the polyamide resin and the reinforcing fibers is 90% by mass or more of the composition; wherein a proportion of an aromatic polyamide having a melting point of from 200 to 250° C. in the polyamide resin is more than 70% by mass; and wherein the content of the reinforcing fibers in the total mass of the polyamide resin and the reinforcing fibers is from 45 to 70% by mass.

In one embodiment of the polyamide resin composition for a slide fastener according to the present invention, the proportion of the aromatic polyamide having the melting point of from 200 to 250° C. in the polyamide resin is more than 80% by mass.

In another embodiment of the polyamide resin composition for a slide fastener according to the present invention, the polyamide resin further contains an aliphatic polyamide having a water absorption rate less than that of the aromatic polyamide and having a melting point of from 200 to 250° C.

In yet another embodiment of the polyamide resin composition for a slide fastener according to the present invention, a proportion of a polyamide MXD6 having a melting point of from 200 to 250° C. in the polyamide resin is more than 70% by mass.

In yet another embodiment of the polyamide resin composition for a slide fastener according to the present invention, the proportion of the polyamide MXD6 having a melting point of from 200 to 250° C. in the polyamide resin is from 80 to 95% by mass; and a proportion of the aliphatic polyamide having a water absorption rate less than that of the aromatic polyamide and having a melting point of from 200 to 250° C., in the polyamide resin, is from 5 to 20% by mass.

In yet another embodiment of the polyamide resin composition for a slide fastener according to the present invention, a melt flow rate of the polyamide resin composition is from 10 to 50 g/10 min.

In another aspect, the present invention is a part for a slide fastener, made of the polyamide resin composition for a slide fastener according to the present invention.

In one embodiment, the part for a slide fastener according to the present invention is a pull tab, a pull tab cover, a top stop, a bottom stop or an element.

In another embodiment, the part for a slide fastener according to the present invention is the element.

In yet another embodiment, the part for a slide fastener according to the present invention has been dyed.

In yet another aspect, the present invention is a fastener stringer in which a plurality of elements according to the present invention are attached to a side edge of a fastener tape to form an element row.

In yet another aspect, the present invention is a slide fastener comprising the part for a slide fastener or the fastener stringer according to the present invention.

In one embodiment, the slide fastener according to the present invention comprises at least one part selected from a group consisting of a pull tab, a pull tab cover, a top stop, a bottom stop and an element row made of the polyamide resin composition for a slide fastener according to the present invention.

In another embodiment, the slide fastener according to the present invention further comprises a slider body made of a polyamide resin composition comprising a polyamide resin and reinforcing fibers, the composition being such that a total mass of the polyamide resin and the reinforcing fibers is 90% by mass or more of the composition, and a proportion of an aliphatic polyamide having a melting point of from 220 to 310° C. in the polyamide resin is 60% by mass or more, and a content of the reinforcing fibers in the total mass of the polyamide resin and the reinforcing fibers is from 45 to 70% by mass.

In yet another embodiment, the slide fastener according to the present invention further comprises a pull tab and a pull tab cover made of the polyamide resin composition for a slide fastener according to the present invention, and further comprises a slider body made of a polyamide resin composition comprising a polyamide resin and reinforcing fibers, the composition being such that the total mass of the polyamide resin and the reinforcing fibers is 90% by mass or more of the composition, and a proportion of an aliphatic polyamide having a melting point of from 220 to 310° C. in the polyamide resin is 60% by mass or more, and a content of the reinforcing fibers in the total mass of the polyamide resin and the reinforcing fibers is from 45 to 70% by mass.

In yet another embodiment, the slide fastener according to the present invention further comprises an element row made of the polyamide resin composition for a slide fastener according to the present invention, and further comprises a slider body made of a polyamide resin composition comprising a polyamide resin and reinforcing fibers, the composition being such that a total mass of the polyamide resin and the reinforcing fibers is 90% by mass or more of the composition, and a proportion of an aliphatic polyamide having a melting point of from 220 to 310° C. in the polyamide resin is 60% by mass or more, and a content of the reinforcing fibers in the total mass of the polyamide resin and the reinforcing fibers is from 45 to 70% by mass.

Effects of the Invention

By producing small parts such as a pull tab cover, a pull tab, a top stop, a bottom stop and elements using the resin composition for a slide fastener according to the present invention as a material, a slide fastener having good strength after being dyed is obtained. In particular, a slide fastener having both good strength and good reciprocating opening and closing durability is obtained by forming, on one hand, a slider body from a material mainly based on an aliphatic polyamide, and forming, on the other hand, these small parts from a material mainly based on an aromatic polyamide, and incorporating reinforcing fibers into both.

Figure 1:
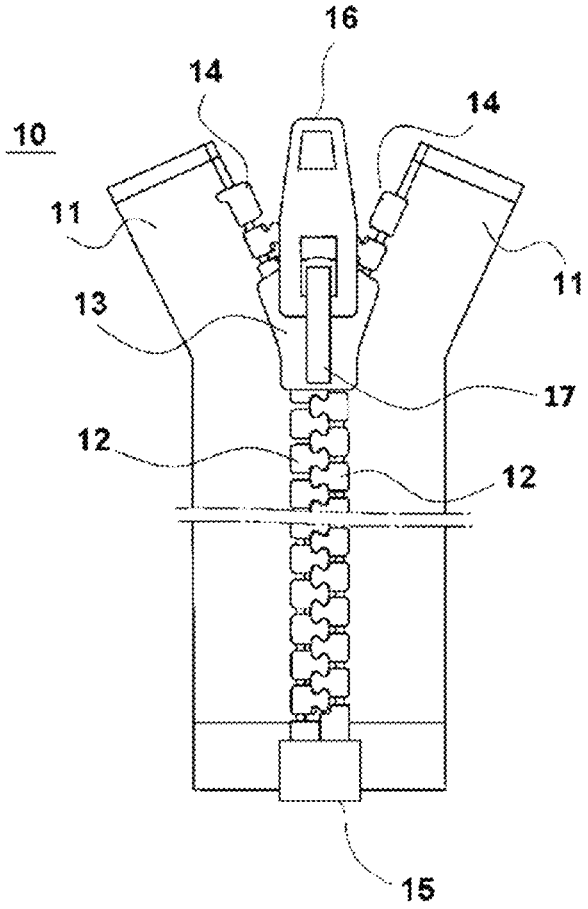
FIG. 1 is a front view showing a structural example of the slide fastener according to the present invention.

MODES FOR CARRYING OUT THE INVENTION (1. Polyamide Resin Composition Suitable for Small Parts)

<1-1 Aromatic Polyamides>

One embodiment of the polyamide resin composition for a slide fastener according to the present invention can include, as one of the features, the use of an aromatic polyamide having a melting point of 200 to 250° C.

The melting point of the aromatic polyamide of 250° C. or less can provide flow properties that are advantageous for injection molding even to small parts such as a pull tab, a pull tab cover, a top stop, a bottom stop and elements. Especially, the elements are small parts whose fluidity during injection molding is important. If the temperature during injection molding is too high, a problem of burning of the fastener tape will occur. Therefore, it is advantageous that the melting point of the aromatic polyamide used is restrained to 250° C. or below. The melting point of the aromatic polyamide is preferably 245° C. or less, more preferably 240° C. or less.

Moreover, since the polyamide resin with a low melting point has a reduced number of the amide bond per unit molecular structure and is in the form of a flexible chain, its strength and rigidity tends to decrease. Thus, aromatic polyamides having a melting point of 200° C. or more are preferably used, aromatic polyamides having a melting point of 210° C. or more are preferably used, and aromatic polyamides having a melting point of 220° C. or more are more preferably used.

In the present invention, it is understood that the melting point of the aromatic polyamide is a temperature of an endothermic peak top when measuring an endothermic energy amount by DSC (a differential scanning calorimetry). When using a plurality of aromatic polyamides, a temperature of an endothermic peak top of the highest temperature side is defined to be a melting point. Therefore, when using a plurality of aromatic polyamides, the melting point will be measured based on the aromatic polyamide with the highest melting point. However, even when using a plurality of aromatic polyamides, all the melting points of respective polyamide resins are preferably within the range as mentioned above.

One embodiment of the polyamide resin composition for a slide fastener according to the present invention can be further characterized in that the proportion of the aromatic polyamide having the melting point of the polyamide resin of 200 to 250° C. is greater than 70% by mass. The use of the polyamide resin mainly based on the aliphatic polyamide in the small parts such as a pull tab, a pull tab cover, a top stop, a bottom stop and elements will make it difficult to exert an effect of improving the strength by the reinforcing fibers, and the polyamide resin which has absorbed moisture via a dyeing step will not result in fastener parts having sufficient strength. The use of the polyamide resin mainly based on the aromatic polyamide will suppress a decrease in the strength after water absorption in small parts such as the pull tab, the pull tab cover, the top stop, the bottom stop and the elements.

The proportion of the aromatic polyamide having the melting point of 200 to 250° C. in the polyamide resin is preferably at least 75% by mass, and more preferably at least 80% by mass, and even more preferably at least 85% by mass. The proportion of the aromatic polyamide having the melting point of 200 to 250° C. in the polyamide resin may be 100% by mass. However, as described below, the strength of the fastener parts can be improved by incorporating a small amount of aliphatic polyamide exhibiting the defined melting point and water absorption rate into the polyamide resin. Thus, the proportion of the aromatic polyamide having the melting point of 200 to 250° C. in the polyamide resin is preferably 95% by mass or less, and more preferably 90% by mass or less.

The aromatic polyamides refer to polyamides having at least one aromatic ring in one molecule, and are generally classified into those synthesized from aromatic diamines and aromatic dicarboxylic acids as raw materials, those synthesized from aromatic diamines and aliphatic dicarboxylic acids as raw materials, or those synthesized from aliphatic diamines and aromatic dicarboxylic acids as raw materials.

The aromatic diamines include m-xylylenediamine, p-xylylenediamine, m-phenylenediamine and p-phenylenediamine and the like. The aliphatic diamines include linear or branched aliphatic diamines, such as, for example ethylenediamine, propylenediamine, butylenediamine, hexamethylenediamine, 2-methylpropanediamine, 3-methylpropanediamine, octamethylenediamine, decanediamine and dodecanediamine. The aromatic dicarboxylic acids include phthalic acid, terephthalic acid, isophthalic acid, naphthalenedicarboxylic acid, 2-chloroterephthalic acid, 2-methylterephthalic acid, 5-methylisophthalic acid, and 5-sodiumsulfoisophthalic acid and 1,5-naphthalenedicarboxylic acid, and the like. The aliphatic dicarboxylic acids include linear or branched aliphatic dicarboxylic acids, such as, for example, succinic acid, propanedioic acid, butanedioic acid, pentanedioic acid, adipic acid, heptanedioic acid, octanedioic acid, nonanedioic acid, decanedioic acid, dodecanedioic acid, undecanedioic acid, dimer acid, and hydrogenated dimer acid.

Specific examples of the aromatic polyamides include polyhexamethyleneisophthalamide (polyamide 61), polyhexamethyleneterephthalamide (polyamide 6T), poly (m-xylyleneadipamide) (polyamide MXD6), poly (p-xylyleneadipamide) (polyamide PXD6), polybis(3-methyl-4-aminohexyl)methaneterephthalamide (polyamide PACMT), polybis(3-methyl-4-aminohexyl)methaneisophthalamide (polyamide PACMI), polytetramethyleneterephthalamide (polyamide 4T), polypentamethyleneterephthalamide (polyamide 5T), poly2-methylpentamethyleneterephthalamide (polyamide M-5T), polyhexamethylenehexaterephthalamide (polyamide 6T), polyhexamethylenehexahydroterephthalamide (polyamide 6T(H)), poly2-methyloctamethyleneterephthalamide, poly2-methyloctamethyleneterephthalamide, polynonamethyleneterephthalamide (polyamide 9T), polydecamethyleneterephthalamide (polyamide 10T), polyundecamethyleneterephthalamide (polyamide 11T), polybis(3-methyl-4-aminohexyl)methaneterephthalamide (polyamide PACMT), polybis(3-methyl-4-aminohexyl)methaneisophthalamide (polyamide PACMI), and the like. These may be used alone or in combination with two or more of these.

The melting point of the polyamide resin varies depending on its molecular structure and molecular weight. Moreover, even if the molecular structure is identical, a different molecular weight may result in a different melting point. Therefore, these melting points of the aromatic polyamides can be adjusted by controlling their molecular weights. A higher molecular weight can increase the melting point, and conversely, a lower molecular weight can decrease the melting point.

Among the aromatic polyamides, the polyamide MXD6 is preferred, for the reasons that they provide good strength even after water absorption and that their commercial products having the melting point in the range as described above are easily available. Therefore, 90% by mass or more of the aromatic polyamide ingredient used in the polyamide resin according to the present invention is preferably made of polyamide MXD6, and more preferably 95% by mass or more is made of polyamide MXD6, and further preferably 99% by mass or more is made of polyamide MXD6, and even more preferably 100% by mass is made of polyamide MXD6.

<1-2 Aliphatic Polyamides>

One embodiment of the polyamide resin composition for a slide fastener according to the present invention can be also characterized in that it incorporates an aliphatic polyamide having a water absorption rate lower than that of the aromatic polyamide as described above, and having a melting point of 200 to 250° C. As stated above, one of the characteristics of the polyamide resin used in the present invention is to comprise the aromatic polyamide as a main ingredient. This provides an advantage that more improved strength after being dyed is obtained by incorporating the defined aliphatic polyamide as an auxiliary ingredient, than by using the aromatic polyamide alone.

The present inventors have found that fastener parts having high strength after being dyed was stably obtained by incorporating aromatic polyamides having a lower water absorption rate than that of the aromatic polyamide used (e.g., when it is MXD6, the water absorption rate is 5% or more). The water absorption rate of the aliphatic polyamide to be used is preferably less than 5%, more preferably 4% or less, even more preferably 3.5% or less, and even more preferably 3% or less.

In the present invention, the water absorption rate means saturated water absorption rate measured with respect to a flat plate injected by injection molding, according to JIS K7209:2000.

Moreover, although the merits of setting the melting point of the aliphatic polyamide to 200-250° C. are as mentioned in the description sections of the aromatic polyamide, preferred embodiments will be described by way of caution. The melting point of the aliphatic polyamide is preferably 245° C. or less, and more preferably 240° C. or less. The melting point of the aliphatic polyamide is preferably 210° C. or more, and more preferably 220° C. or more.

In the present invention, it is understood that the melting point of the aliphatic polyamide is a temperature of an endothermic peak top when measuring an endothermic energy amount by DSC (a differential scanning calorimetry). When using a plurality of aliphatic polyamides, a temperature of an endothermic peak top of the highest temperature side is defined to be a melting point. Therefore, when using a plurality of aliphatic polyamides, the melting point will be measured based on an aliphatic polyamide having the highest melting point. However, even if a plurality of aliphatic polyamides are used, all the melting points of the respective polyamide resins are preferably within the range as described above.

Regarding the proportion of the aliphatic polyamide resin exhibiting the defined melting point and water absorption rate as described above in the polyamide resin, there is a preferable range within which an effect of improving the strength after water absorption is obtained. When the proportion of the aliphatic polyamide in the polyamide resin is 5% by mass or more, and preferably 10% by mass or more, the effect of improving the strength is significantly expressed. However, since the introducing of an excessive amount of such an aliphatic polyamide contrarily causes a decrease in the strength, the proportion of such an aliphatic polyamide is preferably not more than 40% by mass in the polyamide resin, more preferably not more than 30% by mass, and still more preferably not more than 20% by mass.

The aliphatic polyamides refer to polyamides composed of an aliphatic backbone, and can be generally classified into those synthesized from aliphatic amines and aliphatic dicarboxylic acids as raw materials, or those synthesized from aliphatic w-amino acids or lactams thereof as raw materials.

The aliphatic diamines include, for example, linear or branched aliphatic diamines, such as ethylenediamine, propylenediamine, butylenediamine, hexamethylenediamine, 2-methylpropanediamine, 3-methylpropanediamine, octamethylenediamine, decanediamine and dodecanediamine. The aliphatic dicarboxylic acids include, for example, linear or branched aliphatic dicarboxylic acids, such as succinic acid, propanedioic acid, butanedioic acid, pentanedioic acid, adipic acid, heptanedioic acid, octanedioic acid, nonanedioic acid, decanedioic acid, dodecanedioic acid, undecanedioic acid, dimer acid, and hydrogenated dimer acid. The aliphatic w-amino acids include, for example, 6-aminohexanoic acid, 11-aminoundecanoic acid and 12-aminododecanoic acid, and the like. The lactams include c-caprolactam, undecanelactam and lauryllactam, and the like.

A specific structure of the aliphatic polyamide includes, but are not limited to, typically a polyamide comprising repeating monomer units or combinations thereof, represented by the following formula: $—NHR_1NHC(=O)R_2C(=O)—$ or $—NHR_1C(=O)—$, wherein $R_1$ and $R_2$ are the same or different groups and are each an alkylene group having at least 2 carbon atoms, and preferably an alkylene group having 2 to 12, more preferably 6 to 10 carbon atoms. Specific examples of the aliphatic polyamides include, in addition to aliphatic polyamides synthesized by co-condensation polymerization reaction of aliphatic diamines with aliphatic dicarboxylic acids, such as polytetramethyleneadipamide (polyamide 46), polyhexamethyleneadipamide (polyamide 66), polyhexamethyleneazelamide (polyamide 69), polyhexamethylenesebacamide (polyamide 610), polyhexamethylenedodecanediamide (polyamide 612), polyheptamethylenepimelamide (polyamide 77), polyoctamethylenesuberamide (polyamide 88), polynonamethyleneazelamide (polyamide 99) and polydecamethyleneazelamide (polyamide 109); aliphatic polyamides synthesized by polycondensation reaction of ω-amino acids or ring opening polymerization of lactams, such as poly(4-aminobutyric acid) (polyamide 4), poly(6-aminohexanoic acid) (polyamide 6), poly(7-aminoheptanoic acid) (polyamide 7), poly(8-aminooctanoic acid) (polyamide 8), poly(9-aminononanoic acid) (polyamide 9), poly(10-aminodecanoic acid) (polyamide 10), poly(11-aminoundecanoic acid) (polyamide 11), and poly(12-aminododecanoic acid) (polyamide 12). These may be used alone or in combination with two or more of these.

Furthermore, copolymers obtained by any combination of repeating units of the aliphatic polyamides can be used. Such aliphatic copolyamides include, but not limited to, a caprolactam/hexamethylene-adipamide copolymer (nylon 6/6,6), a hexamethylene-adipamide/caprolactam copolymer (nylon 6,6/6), a hexamethylene-adipamide/hexamethylene-azelaicamide copolymer (nylon 6,6/6,9), and the like.

As with the aromatic polyamides, the melting points of these aliphatic polyamides can be adjusted by controlling the molecular weights. A higher molecular weight can increase the melting point, and conversely a lower molecular weight can decrease the melting point.

Among the aliphatic polyamides, in terms of providing good strength even after water adsorption and availability of commercial products having the melting point in the range described above, at least one selected from the group consisting of polyamide 66, polyamide 610 and polyamide 612 is more preferred, polyamide 612 being more preferred. Thus, at least 90% by mass of the aliphatic polyamide ingredients according to the present invention is preferably made of these three kinds, at least 95% by mass is more preferably made of these three kinds, at least 99% by mass is even more preferably made of these three kinds, and 100% by mass is more preferably made of these three kinds. Furthermore, at least 90% by mass of the aliphatic polyamide ingredients according to the present invention is preferably made of polyamide 612, at least 95% by mass is more preferably made of a polyamide 612, at least 99% by mass is even more preferably made of polyamide 612, and 100% by mass is further more preferably made of polyamide 612.

<1-3 Reinforcing Fibers>

The strength of the fastener parts can be reinforced by containing reinforcing fibers in the polyamide resin composition. Since it is expected that the polyamides improve affinity to the reinforcing fibers as compared with the polyesters, by treating the surfaces with a silane coupling agent, a titanate-based coupling agent or an aluminate-based coupling agent, or like, they can acquire high rigidity without impairing the strength even if a large amount of the reinforcing fibers are added. More particularly, the concentration of the reinforcing fiber in the total mass of the reinforcing fibers and the polyamide resin is preferably at least 45%, and more preferably at least 50% by mass. However, since moldability is deteriorated and also the strength is reduced when the concentration of the reinforcing fibers is too high, the concentration of the reinforcing fiber in the total mass of the reinforcing fibers and the polyamide resin is preferably 70% by mass or less, and more preferably 60% by mass or less.

The reinforcing fibers used in the present invention may include, but are not limited to, for example, organic fibers such as carbon fibers, aramid fibers, as well as inorganic fibers such as glass fibers, needle-shaped wollastonite, whiskers (e.g., calcium titanate whisker, calcium carbonate whisker, aluminum borate whisker) and the like. For the reason that the strength can be improved while maintaining fluidity at a certain level or more, any one or more selected from the glass fibers, the aramid fibers and the carbon fibers are preferably used, the glass fibers being more preferred. These may be used alone or in combination with two or more of these.

An average fiber diameter prior to being compounded into the resin is preferably from about 3 to 20 μm, and more preferably from about 5 to 12 μm. The average fiber length prior to being compounded into the resin is preferably from about 1 mm to 10 mm, more preferably from about 3 mm to 6 mm. Here, the fiber diameter refers to a diameter when determining the cross-sectional area of the reinforcing fiber and regarding its cross-sectional area as a true circle. The aspect ratio prior to being compounded into the resin=an average fiber diameter: an average fiber length is preferably from 1:50 to 3:10000, and more preferably 1:300 to 1:1200. After being compounded into the resin and being molded, the average fiber length of the reinforcing fibers is generally from 1/10 to 1/20, for example from 0.1 to 1 mm, and typically from 0.1 to 0.5 mm.

The total content of the polyamide resin and the reinforcing fibers in the polyamide resin composition is preferably at least 90% by mass, more preferably at least 95% by mass, in order to achieve the desired strength.

<1-4 Pigments and Other Additives>

Although the polyamide resins have less color reproducibility because they are sensitive to yellowing, the color reproducibility can be improved by adding a pigment. On the other hand, since an increased amount of the pigment added causes problems that the strength is reduced and the high-density color does not appear during dyeing because they are too whity, the addition at an elevated concentration is not preferred. From the viewpoint of color reproducibility, the content of the pigment in the polyamide resin composition is preferably at least 0.5% by mass relative to the total mass of the polyamide resin and reinforcing fibers, and more preferably at least 1.0%. Further, from the viewpoint of deep color dyeability, the content of the pigment in the polyamide resin composition is preferably less than 5.0% by mass, and more preferably 4.5% by mass or less based on the total mass of the polyamide resin and reinforcing fibers. Since if an amount of the pigment is too much, the white color is too strong, a red color becomes a pink color for example, and so it will make it difficult to show a deep color. Examples of the pigments include, but are not limited to, zinc sulfide, antimony oxide, titanium oxide, zinc oxide and the like, and zinc sulfide is preferred in terms of safety.

In addition to these, conventional additives such as heat stabilizers, weathering agents, hydrolysis inhibitors and antioxidants may be added to the polyamide resin composition, for example in a total amount of 10.0% by mass or less, typically 5% by mass or less, and more typically 2% by mass or less.

In particular, for the elements having a small size, it is preferable to add metal salts of fatty acids having 20 or more and 40 or less carbon atoms, preferably metal salts of montanic acid, because they can facilitate easy injection molding without sacrificing the strength. Specific examples of the montanic acid metal salts include calcium montanate, sodium montanate, zinc montanate, lithium montanate, magnesium montanate, aluminum montanate and the like. The content of the fatty acid salt is preferably from 0.1 to 2.0 parts by mass based on the total 100 parts by mass of the polyamide resin and the reinforcing fibers. The content of 0.1 part by mass or more can produce an effect of improving moldability, as well as the content of 2.0 parts by mass or less can significantly inhibit bleeding out due to aged deterioration, and a change in color tone due to yellowing. The content of the fatty acid salt is more preferably from 0.3 to 1.0 parts by mass based on the total 100 parts by mass of the polyamide resin and the reinforcing fibers.

<1-5 Melt Flow Rate>

The present invention preferably controls a melt flow rate (MFR) of the polyamide resin composition to be used. The MFR is changed under the influence such as the molecular weight of the polyamide or the content of the reinforcing fibers. An excessively low MFR deteriorates filling rate during injection molding of the fastener parts because of the deterioration of flow property, which causes problems such as a decrease in yield and prolonged molding cycle, and the like. On the other hand, an excessively high MFR causes problems of reduced strength, as well as a poor appearance due to development of flow unevenness resulting from broadening of the molecular weight, or poor dimensional stability in summer environment due to the influence of water absorption resulting from the polymer ingredient, and the like. Preferable MFR is from 5 to 40 g/10 min, more preferable MFR is from 8 to 30 g/10 min, and even more preferable MFR is from 10 to 25 g/10 min. In the present invention, the MFR is measured at 280° C. and under a measuring load of 2.16 kg, according to JIS K7210 (Method A). The use of the resin composition having the MFR within this range allows molded parts for a slide fastener having good moldability and good quality stability to be produced with a high production efficiency.

(2. Polyamide Resin Composition Suitable for a Slider Body)

Among the fastener parts, small parts such as a pull tab, a pull tab cover, a top stop, a bottom stop and elements are preferably made using the polyamide resin mainly based on the aromatic polyamide as described above. However, for the slider body, there are strong needs for not only the strength but also reciprocating opening and closing durability. Further, the slider body is a relatively larger part among the fastener parts, and difficulty during injection molding is less. Therefore, a material having a relatively high melting point can be also used for the slider body. Improvement of the strength can be expected by using the material with a higher melting point. Further, since it is a relatively large part, it tends to produce the effect of improving the strength by the reinforcing fibers, and there is no need to worry about the reduced strength due to water absorption during dyeing.

In one embodiment, the polyamide resin composition suitable for the slider body according to the present invention contains a polyamide resin and reinforcing fibers, wherein the total mass of the polyamide resin and the reinforcing fibers accounts for 90% by mass or more in the composition, and wherein the proportion of the aliphatic polyamide having a melting point of 220 to 310° C. in the polyamide resin is 60% by mass or more, and wherein the content of the reinforcing fiber in the total mass of the polyamide resin and the reinforcing fibers is from 45 to 70% by mass.

<2-1 Aliphatic Polyamides>

In one embodiment of the aliphatic polyamides suitable for the slider body according to the present invention, aliphatic polyamides having a melting point of 220 to 310° C. may be used. Since the slider body is a relatively larger part, it can be subjected to injection molding even at an elevated melting point. However, if an aliphatic polyamide with an excessively high melting point is used, the molding temperature is elevated, thereby tending to turn yellow. Therefore, it is preferable to use an aliphatic polyamide having a melting point of 310° C. or less, and more preferably an aliphatic polyamide having a melting point of 305° C. or less, and further more preferably an aliphatic polyamide having a melting point of 300° C. or less. Further, a polyamide resin having a lower melting point tends to decrease the strength and rigidity because the number of amide bonds per unit molecular structure is reduced, thereby resulting in the form of a flexible chain. Therefore, it is preferable to use aliphatic polyamides having a melting point of 220° C. or more, and more preferably aliphatic polyamides having a melting point of 240° C. or more, and further more preferably aliphatic polyamides having a melting point of 250° C. or more.

In one embodiment of the aliphatic polyamides suitable for the slider body according to the present invention, the proportion of the aliphatic polyamide having the melting point of 220 to 310° C. in the polyamide resin is 60% by mass or more. The reciprocating opening and closing durability can be improved by increasing the proportion of the aliphatic polyamide to be incorporated. The slider body is a part that is most frequently subjected to friction caused by the sliding with the elements, and it is thus important to increase the reciprocating opening and closing durability. From the perspective of an increase in the reciprocating opening and closing durability, the proportion of the aliphatic polyamide having the melting point of 220 to 310° C. in the polyamide resin may is preferably 65% by mass or more.

However, as described below, the strength of the fastener parts can be improved by formulating the aromatic polyamide having the defined melting point. Therefore, the proportion of the aliphatic polyamide having the melting point of 220 to 310° C. in the polyamide resin may be preferably 90% by mass or less, and more preferably 80% by mass or less, and still more preferably 75% by mass or less.

It is understood that the melting point of the aliphatic polyamide is a temperature of an endothermic peak top when measuring an endothermic energy amount by DSC (a differential scanning calorimetry). When using a plurality of aliphatic polyamides, a temperature of an endothermic peak top of the highest temperature side is defined to be a melting point. Therefore, when using a plurality of aliphatic polyamides, the melting point will be measured based on the aliphatic polyamide having the highest melting point. However, even when using a plurality of aliphatic polyamides, all the melting points of the respective polyamide resins are preferably within the range mentioned above.

The molecular structure and specific examples of the aliphatic polyamide are as previously described in the paragraphs of "1. Polyamide resin compositions suitable for small parts". The same is also true for the preferable types of the aliphatic polyamides.

<2-2 Aromatic Polyamides>

In one embodiment of the polyamide resin composition suitable for the slider body according to the present invention, an aromatic polyamide having a melting point of 230 to 310° C. can be incorporated. An effect of improving the strength can be expected by incorporating the aromatic polyamide.

Since the slider body is a relatively larger part, it can be subjected to injection molding even at an elevated melting point. However, if an aromatic polyamide with an excessively high melting point is used, the molding temperature is elevated, thereby tending to undergo yellowing. Therefore, it is preferable to use aromatic polyamides having a melting point of 310° C. or less, and more preferably aromatic polyamides having a melting point of 305° C. or less, and further more preferably aromatic polyamides having a melting point of 300° C. or less. Further, the polyamide resin having the lower melting point tends to decrease the strength and rigidity because the number of amide bonds per unit molecular structure is reduced, thereby resulting in the form of a flexible chain. Therefore, it is preferable to use aromatic polyamides having a melting point of 230° C. or more, and more preferably aromatic polyamides having a melting point of 240° C. or more, and further more preferably aromatic polyamides having a melting point of 250° C. or more.

In one embodiment of the polyamide resin composition suitable for the slider body according to the present invention, the proportion of the aromatic polyamide having the melting point of 230 to 310° C. in the polyamide resin is 10% by mass or more. In order to further enhance the effect of improving the strength, the proportion of the aromatic polyamide having the melting point of 230 to 310° C. in the polyamide resin is preferably 20% by mass or more, and more preferably 25% by mass or more. However, from the perspective of compatibility of the reciprocating opening and closing durability with the strength, the aliphatic polyamide as stated above should be mainly present. Therefore, the proportion of the aromatic polyamide having the melting point of 230 to 310° C. in the polyamide resin is preferably 40% by mass or less, and more preferably 35% by mass or less.

It is understood that the melting point of such an aromatic polyamide is a temperature of an endothermic peak top when measuring an endothermic energy amount by DSC (a differential scanning calorimetry). When using a plurality of aromatic polyamides, a temperature of an endothermic peak top of the highest temperature side is defined to be a melting point. Therefore, when using a plurality of aromatic polyamides, the melting point will be measured based on the aromatic polyamide having the highest melting point. However, even when using a plurality of aromatic polyamides, all the melting points of the respective polyamide resins are preferably within the range mentioned above.

The molecular structure and specific examples of the aromatic polyamide are as previously described in the paragraphs of "1. Polyamide resin compositions suitable for small parts". The same is also true for the preferable types of the aromatic polyamides.

<2-3 Reinforcing Fibers>

The strength of the slider body can be enhanced by incorporating the reinforcing fibers into the polyamide resin composition. The specific embodiments and content of the reinforcing fibers are as previously described in the paragraphs of "1. Polyamide resin compositions suitable for small parts". Also in the slider body, the total content of the polyamide resin and the reinforcing fibers in the polyamide resin composition is preferably 90% by mass or more, and more preferably 95% by mass, from the perspective of achieving the desired strength.

<2-4 Pigments and Other Additives>

Although the polyamide resins have less color reproducibility because they are sensitive to yellowing, the color reproducibility can be improved by adding a pigment. On the other hand, since an increased amount of the pigment added causes problems that the strength is reduced and the high-density color does not appear during dyeing because they are too whity, the addition at an elevated concentration is not preferred. From the viewpoint of color reproducibility, the content of the pigment in the polyamide resin composition may be preferably at least 0.5% by mass and more preferably at least 1.0% by mass based on the total mass of the polyamide resin and reinforcing fibers. Further, from the viewpoint of deep color dyeability, the content of the pigment in the polyamide resin composition may be preferably less than 5.0% by mass and more preferably 4.5% by mass or less based on the total mass of the polyamide resin and reinforcing fibers. Since if an amount of the pigment is too much, the white color is too strong, a red color becomes a pink color for example, and it will make it difficult to show a deep color. Examples of the pigments include, but are not limited to, zinc sulfide, antimony oxide, titanium oxide, zinc oxide and the like, and zinc sulfide is preferred in terms of safety.

In addition to these, conventional additives such as heat stabilizers, weathering agents, hydrolysis inhibitors and antioxidants may be added to the polyamide resin composition, for example in a total amount of 10.0% by mass or less, typically 5% by mass or less, and more typically 2% by mass or less.

(3. Slide Fastener)

The polyamide resin composition according to the present invention can be used as a material to produce various parts for a slide fastener, and assemble them to form a slide fastener. More particularly, the polyamide resin described in the paragraphs of "1. Polyamide resin composition suitable for small parts" can be used as a material to produce small parts such as a pull tab, a pull tab cover, a top stop, a bottom stop and elements, by means of injection molding. A fastener stringer can be produced in which an element row is formed by attaching a plurality of elements onto a side edge of a fastener tape. Further, the polyamide resin composition described in the paragraphs of "2. Polyamide resin composition suitable for a slider body" can be used as a material to produce a slider body, by means of injection molding.

In one embodiment of the slide fastener according to the present invention, a slider can be produced, the slider comprising a pull tab and a pull tab cover made of the polyamide resin composition described in the paragraphs of "1. Polyamide resin composition suitable for small parts", and further comprising a slider body made of the polyamide resin composition described in the paragraphs of "2. Polyamide resin composition suitable for a slider body". Further, a slide fastener comprising such a slider can be produced. Such a slider is advantageous for the slider overall strength or pull tab twist strength after being dyed, while providing good reciprocating opening and closing durability.

Figure 2:
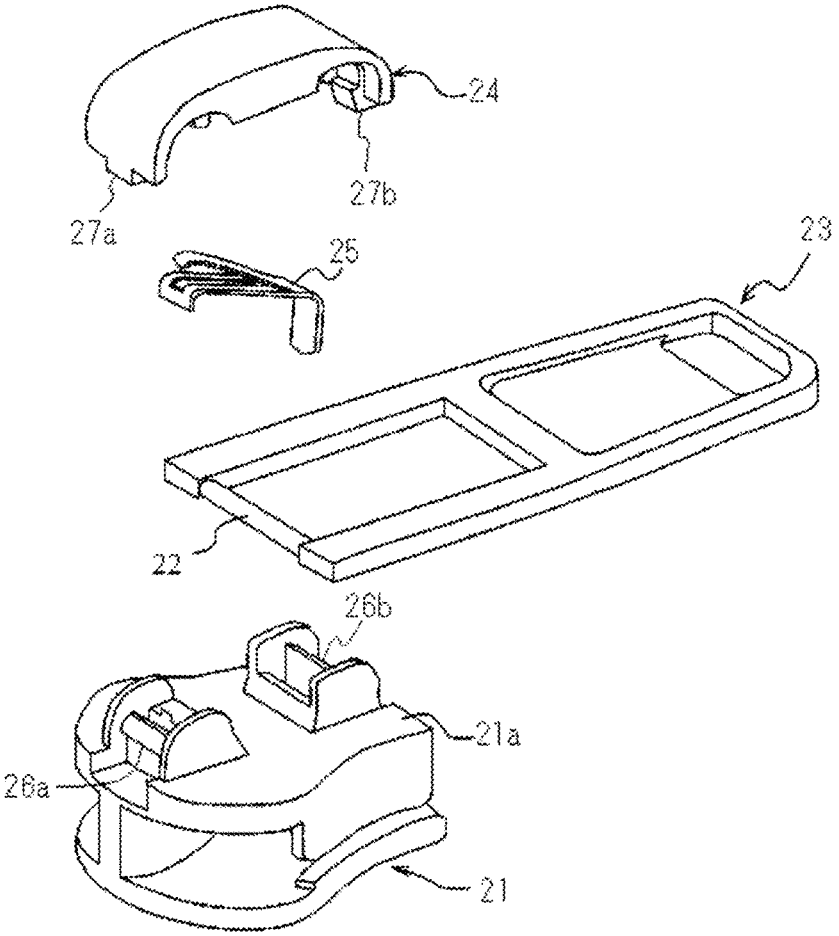
FIG. 2 is an exploded perspective view of one embodiment of the slider according to the present invention.
Figure 3:
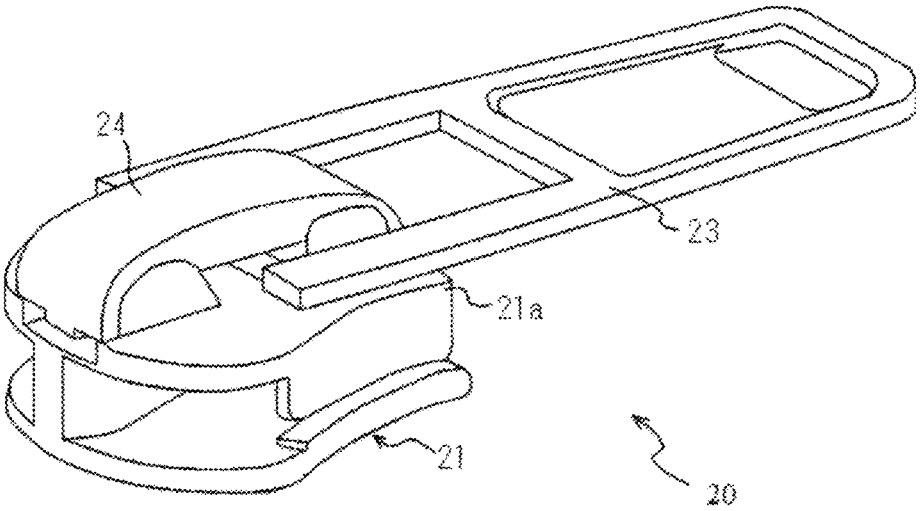
FIG. 3 is a perspective view of a slider made by assembling the respective components shown in FIG. 2.

Structural examples of such a slider are shown in FIGS. 2 and 3. The slider 20 comprises a slider body 21; a pull tab 23 which is connected to the side of an upper blade plate 21*a* of the slider body 21 and which is to be held by the user when sliding and displacing the slider 20 in order to engage or separate element rows; and a pull tab cover 24 for holding one end portion 22 of the pull tab 23 between the upper blade plate 21*a* and the pull tab cover, and rotatably holding the pull tab 2 at the one end portion 22 on the outer surface of the upper blade plate 21*a*. Further, an elastic plate-like member 25 made of a metal is interposed between the upper blade plate 21*a* and the pull tab cover 24, in order to impart an automatic stop function. The upper blade plate 21*a* and the pull tab cover 24 are connected by engaging a pair of claw portions 26*a*, 26*b* protruding from the outer surface of the upper blade plate 21 with a pair of claw portions 27*a*, 27*b* formed on the front and rear portions of the pull tab cover 24.

As materials of the elements to be combined with the slider, the polyamide resin as described above in the paragraphs of "1. Polyamide resin composition suitable for small parts" is preferred from the perspective of mechanical strength such as chain crosswise strength or impact strength, but not limited thereto. The slide fastener may be constructed in combination with the elements made of various materials including thermoplastic polyether resins such as polyoxymethylene (POM); thermoplastic polyester resins such as polybutylene terephthalate (PBT); thermoplastic polyolefin resins such as polypropylene; thermoplastic polyvinyl resins such as polyvinyl chloride (PVC); and thermoplastic fluororesins such as ethylene tetrafluoroethylene.

Further, elements retaining high strength even after being dyed may be provided by producing the elements using as their materials the polyamide resin composition described in "1. Polyamide resin composition suitable for small parts". Then, as a material of the slider body to be combined with such elements, the polyamide resin composition described in the paragraphs of "2. Polyamide resin composition suitable for a slider body" is preferred from the perspective of the reciprocating opening and closing durability, but not limited thereto. The slide fastener may be constructed in combination with a resin slider made of various materials such as thermoplastic polyether resins such as polyoxymethylene (POM); thermoplastic polyester resins such as polybutylene terephthalate (PBT); thermoplastic polyolefin resins including polypropylene; thermoplastic polyvinyl resins such as polyvinyl chloride (PVC); and thermoplastic fluororesins such as ethylene tetrafluoroethylene; or a metal slider made of stainless steel, zinc, copper, iron, aluminum and alloys thereof.

The injection molding technique is known in the art and would not require any special explanation, but an example of the injection molding procedure is mentioned. First, the polyamide and the reinforcing fibers which are ingredients for the resin composition are sufficiently kneaded so that there is no deviation of the ingredients. For the kneading, a single-screw extruder, a twin screw extruder and a kneader, and the like may be used. When the resin composition after being kneaded is injection molded using a mold having a predetermined fastener shape, a part for a slide fastener in an undyed state is completed.

When elements are prepared, they are generally injection molded directly on the side edge of the fastener tape, such that a fastener stringer in which an element row is formed by attaching a plurality of elements to the side edge of the fastener tape can be produced. No particular limitation is imposed on the conditions for the injection molding, but the twin-screw extruder can be preferably used. In a case of glass fibers at a high concentration, it is desirable to use a side feeder to mix the glass fibers with a resin in a molten state, in view of productivity.

The parts for a slide fastener in an undyed state may be subjected to dyeing. Dyeing method is not particularly limited, but dip dyeing and printing are representative. Suitable dyes include, but are not limited to, metal complex dyes, acid dyes, threne dyes and disperse dyes, and among these, more particularly, the acid dyes may be preferably used because they have good dyeing properties and fastness. Dyeing may be carried out simultaneously with or separately from other parts of the slide fastener.

The fastener parts according to the present invention may be subjected to metal plating in various manners. The metal plating includes, but not limited to, for example, chromium plating, nickel plating, copper plating, gold plating, brass plating, other alloy plating and the like. The method of metal plating is not particularly limited, and may be carried out by, in addition to electroplating (electroless plating is preferably carried out before the electroplating), dry plating such as a vacuum deposition method, a sputtering method, an ion plating method, and the like, as needed. These methods may be combined. Among these, the electroplating method is preferred, which can be securely covered to the inside of the parts which has small and complex shapes, and more preferably, the electroplating is carried out after preliminarily performing the electroless plating.

EXAMPLES

Examples of the present invention are illustrated below, but they are provided for better understanding of the present invention and its advantages, and are not intended to limit the present invention.

<1. Production of a Pull Tab, a Pull Tab Cover and Elements>

As polyamide resins for the pull tab, the pull tab cover and the elements, the following materials were provided.

MXD6 (melting point: 235° C., water absorption rate: 5.5% (catalog value));

PA 610 (melting point: 225° C., water absorption rate: 4.0% (catalog value));

PA 612 (melting point: 212° C., water absorption rate: 3.0% (catalog value));

PA 6T (melting point: 295° C., water absorption rate: 6.2% (catalog value));

PA 6 (melting point: 225° C., water absorption rate: 10.7% (catalog value)).

As a reinforcing fiber, a glass fiber (an average fiber diameter: 11 μm, an average fiber length before molding: 3 mm, an average fiber length after molding: 0.25 mm) was used.

The polyamide resin and the glass fibers were kneaded using a twin-screw extruder in each proportion as described in Table 1 (mass basis), and then the molten resin was extruded into a strand, and solidified in a cooling water bath, and the strand was cut by a pelletizer to prepare a pellet of each resin composition. The pellet was subjected to injection molding to produce a fastener stringer in which an element row in the configuration shown in FIG. 1 was attached to a side edge of a fastener tape (VISLON) (M-class size as defined in JIS S3015:2007). Also, the pull tab cover and the pull tab having shapes shown in FIG. 2 were produced by injection molding from the pellet in the same manner. Then, these parts were immersed in water at 23° C. for 72 hours.

<2. Production of a Slider Body>

PA 66 (a melting point: 265° C., water absorption rate: 8.8% (catalog value)) and glass fibers (an average fiber diameter: 11 μm, an average fiber length before molding: 3 mm, an average fiber length after molding: 0.25 mm) were kneaded in a mixing ratio of PA 66:glass fiber=40:60 (by mass), using a twin-screw extruder, and then the molten resin was extruded into a strand, and solidified in a cooling water bath, and the strand was then cut by a pelletizer to prepare a pellet of the polyamide resin composition. This was subjected to injection molding to produce a slider body for a slide fastener of M-class defined in JIS S3015:2007 (a chain width is 5.5 mm or more and less than 7.0 mm). The slider body was immersed in water at 23° C. for 72 hours.

<3. Assembly of a Slider and a Fastener Chain>

Using the pull tab, the pull tab cover and the slider body after water absorption, produced as described above, a slider having the structure shown in FIG. 3 was assembled. Then, a fastener chain was assembled by engaging the element rows of a pair of fastener stringers.

<4. Test>

(Melting Point)

The melting point of each polyamide resin was measured using DSC (available from Seiko Instruments Inc.: EXTAR6000) based on the definition previously described, under the following conditions:

sample amount: from 5 to 10 mg;

atmosphere: nitrogen gas;

temperature raising rate: 10° C./min;

range of measured temperature: from 0 to 350° C.;

reference pan: empty.

(Strength of Slider and Chain)

Slider overall strength and slider pull tab twist strength were measured for the produced slider, and a chain crosswise strength test was performed for the produced slide fastener chain, according to JIS S3015:2007, respectively.

(MFR)

MFR was measured for each of the polyamide resin compositions for the pull tab, the pull tab cover and the elements under the previously described measuring conditions.

The results are shown in Table 1. In Examples 1-5, since each polyamide resin composition was appropriately formulated, each composition had higher mechanical strength such as the slider overall strength after water absorption of 169 N or more, the slider pull tab twist strength after water absorption of 58 N or more, and the chain crosswise strength after water absorption of 741 N or more. In particular, Examples 3 and 4 which added a small amount of aliphatic polyamide had outstanding slider overall strength after water absorption. Given that for a general metal chain, the crosswise strength is about 750 N, it can be said that the elements made of the polyamide resin composition according to the present invention exhibit excellent strength.

In contrast, in Comparative Example 1, sufficient slider overall strength and chain crosswise strength after water absorption were not obtained, because the proportion of the glass fiber was too low.

In Comparative Example 2, all the slider overall strength, the pull tab twist strength and the chain crosswise strength, after water absorption, were not satisfactory, because the proportion of MXD6, which is an aromatic polyamide, was too low.

In Comparative Example 3, fluidity was deteriorated by using the aromatic polyamide having a higher melting point, and more particularly, the element rows which are small parts could not be injection molded.

In Comparative Example 4, all the slider overall strength, the pull tab twist strength and the chain crosswise strength were not satisfactory because PA 6, which is an aliphatic polyamide, was used.

In addition, the reciprocating opening and closing durability tests (JIS S3015: 2007) of the sliders in Examples 1 to 5 demonstrated that all their values were 1500 times or more. However, all the reciprocating opening and closing durability tests of the slider bodies which incorporated MXD6 in place of PA 66 demonstrated that defects occurred at the reciprocating of 100 times or less.

TABLE 1

| | Example 1 | Example 2 | Example 3 | Example 4 | Example 5 |
|---|---|---|---|---|---|
| Ingredients | | | | | |
| MXD6 (melting point: 235° C., water absorption rate: 5.5%) | 40% | 50% | 45% | 45% | 40% |
| PA 610 (melting point: 225° C., water absorption rate: 4.0%) | | | 5% | | |
| PA 612 (melting point: 212° C., water absorption rate: 3.0%) | | | | 5% | 10% |
| Glass fibers | 60% | 50% | 50% | 50% | 50% |
| Characterization | | | | | |
| Slider overall strength after water absorption 90° (N) | 171 | 169 | 185 | 187 | 181 |
| Pull tab twist strength after water absorption (N) | 63 | 62 | 63 | 60 | 58 |
| Chain crosswise strength after water absorption (N) | 741 | 769 | 790 | 786 | 780 |
| MFR (g/10 min, 280° C.) | 28.3 | 33.9 | 15.7 | 20.2 | 16.4 |

| | Comp. Example 1 | Comp. Example 2 | Comp. Example 3 | Comp. Example 4 |
|---|---|---|---|---|
| Ingredients | | | | |
| MXD6 (melting point: 235° C., water absorption rate: 5.5%) | 70% | 20% | | |
| PA 6T (melting point: 295° C., water absorption rate: 6.2%) | | | 40% | |
| PA 6 (melting point: 225° C., water absorption rate: 10.7%) | | | | 50% |
| PA 612 (melting point: 212° C., water absorption rate: 3.0%) | | 30% | | |
| Glass fibers | 30% | 50% | 60% | 50% |
| Characterization | | | | |
| Slider overall strength after water absorption 90° (N) | 158 | 161 | 173 | 121 |
| Pull tab twist strength after water absorption (N) | 58 | 50 or less | 61 | 50 or less |
| Chain crosswise strength after water absorption (N) | 708 | 720 | Not moldable | 435 |
| MFR (g/10 min, 280° C.) | 54.2 | 26.3 | Not measurable | 13.7 |

DESCRIPTION OF REFERENCE NUMERALS

10 slide fastener
11 elongated tape
12 element
13 slider
14 top stop
15 opener
16 pull tab
17 pull tab cover
20 slider
21 slider body
21*a* upper blade plate
22 one end portion of pull tab
23 pull tab
24 pull tab cover
25 elastic plate-like member
26*a*, 26*b* claw portion of slider body
27*a*, 27*b* claw portion of pull tab cover

What is claimed is:

1. A polyamide resin composition for a slide fastener, which has absorbed water, the composition comprising a polyamide resin and reinforcing fibers, wherein a total mass of the polyamide resin and the reinforcing fibers is 90% by mass or more of the composition; wherein a proportion of an aromatic polyamide having a melting point of from 200 to 250° C. in the polyamide resin is more than 70% by mass; and wherein a content of the reinforcing fibers in the total mass of the polyamide resin and the reinforcing fibers is from 45 to 70% by mass, wherein the aromatic polyamide is polyamide MXD6 having a saturated water absorption rate of 5% or more measured according to JIS K7209-2000, and wherein a melt flow rate of the polyamide resin composition is from 10 to 50 g/10 min.

2. The polyamide resin composition according to claim 1, wherein the proportion of the aromatic polyamide having the melting point of from 200 to 250° C. in the polyamide resin is more than 80% by mass.

3. The polyamide resin composition according to claim 1, wherein the polyamide resin further contains an aliphatic polyamide having a water absorption rate less than that of the aromatic polyamide and having a melting point is from 200 to 250° C.

4. The polyamide resin composition according to claim 1, wherein the proportion of the aromatic polyamide having the melting point of from 200 to 250° C. in the polyamide resin is from 80 to 95% by mass; and wherein a proportion of the aliphatic polyamide having the water absorption rate less than that of the aromatic polyamide and having the melting point of from 200 to 250° C., in the polyamide resin, is from 5 to 20% by mass.

5. A part for a slide fastener, made of the polyamide resin composition for a slide fastener according to claim 1.

6. The part for a slide fastener according to claim 5, wherein the part is a pull tab, a pull tab cover, a top stop, a bottom stop or an element.

7. The part for a slide fastener according to claim 5, wherein the part is the element.

8. A fastener stringer in which a plurality of elements according to claim 7 are attached to a side edge of a fastener tape to form an element row.

9. A slide fastener comprising the part for a slide fastener according to claim 7 or the fastener stringer according to claim 8.

10. The slide fastener according to claim 9, further comprising a slider body made of a polyamide resin composition comprising a polyamide resin and reinforcing fibers, the composition being such that a total mass of the polyamide resin and the reinforcing fibers is 90% by mass or more of the composition, and a proportion of an aliphatic polyamide having a melting point of from 220 to 310° C. in the polyamide resin is 60% by mass or more, and a content of the reinforcing fibers in the total mass of the polyamide resin and the reinforcing fibers is from 45 to 70% by mass.

11. The part for a slide fastener according to claim 5, wherein the part has been dyed with an acid dye.

12. A slide fastener comprising at least one part selected from a group consisting of a pull tab, a pull tab cover, a top stop, a bottom stop and element rows made of the polyamide resin composition for a slide fastener according to claim 1.

13. The slide fastener according to claim 12, which comprises a pull tab and a pull tab cover made of the polyamide resin composition according to claim 1, and which further comprises a slider body made of a polyamide resin composition comprising a polyamide resin and reinforcing fibers, the composition being such that the total mass of the polyamide resin and the reinforcing fibers is 90% by mass or more of the composition, and a proportion of an aliphatic polyamide having a melting point of from 220 to 310° C. in the polyamide resin is 60% by mass or more, and a content of the reinforcing fibers in the total mass of the polyamide resin and the reinforcing fibers is from 45 to 70% by mass.

14. The slide fastener according to claim 12, which comprises an element row made of the polyamide resin composition according to claim 1, and which further comprises a slider body made of a polyamide resin composition comprising a polyamide resin and reinforcing fibers, the composition being such that a total mass of the polyamide resin and the reinforcing fibers is 90% by mass or more of the composition, and a proportion of an aliphatic polyamide having a melting point of from 220 to 310° C. in the polyamide resin is 60% by mass or more, and a content of the reinforcing fibers in the total mass of the polyamide resin and the reinforcing fibers is from 45 to 70% by mass.

15. The slide fastener claim 12, further comprising a slider body made of a polyamide resin composition comprising a polyamide resin and reinforcing fibers, the composition being such that a total mass of the polyamide resin and the reinforcing fibers is 90% by mass or more of the composition, and a proportion of an aliphatic polyamide having a melting point of from 220 to 310° C. in the polyamide resin is 60% by mass or more, and a content of the reinforcing fibers in the total mass of the polyamide resin and the reinforcing fibers is from 45 to 70% by mass.

* * * * *